US005761774A

United States Patent [19]

Champi

[11] Patent Number: 5,761,774

[45] Date of Patent: Jun. 9, 1998

[54] BAND CLAMP TIGHTENING MEANS

[76] Inventor: Frank Kenneth Champi, 84 Purchase St., Newburyport, Mass. 01950

[21] Appl. No.: 735,935

[22] Filed: Oct. 23, 1996

[51] Int. Cl.[6] ..... B25B 13/00; B65D 63/00

[52] U.S. Cl. ..... 24/274 R; 24/279; 81/64

[58] Field of Search ..... 24/274 R, 279, 24/273, 305, 456, 27; 81/64, 65; 192/69.82, 69.8, 34; 285/38, 253; 74/543, 545

[56] References Cited

U.S. PATENT DOCUMENTS

| | | | |
|---|---|---|---|
| 681,283 | 8/1901 | Waynick | 81/64 |
| 1,146,054 | 7/1915 | Curry | 74/545 |
| 1,383,123 | 6/1921 | Jones | 81/64 |
| 1,650,807 | 11/1927 | Aubin | 81/65 |
| 2,283,179 | 5/1942 | Buckingham | 24/279 |
| 2,619,860 | 12/1952 | Gray, Jr. | 81/64 |
| 4,389,039 | 6/1983 | Domres | 266/77 |
| 4,646,593 | 3/1987 | Robertson | 81/64 |

FOREIGN PATENT DOCUMENTS

| | | | |
|---|---|---|---|
| 0689454 | 4/1965 | Italy | 24/274 R |
| 0379102 | 8/1932 | United Kingdom | 74/545 |
| 0567505 | 2/1945 | United Kingdom | 24/274 R |
| 2098903 | 12/1982 | United Kingdom | 81/64 |

*Primary Examiner*—Victor N. Sakran
*Attorney, Agent, or Firm*—Philip Koenig

[57] ABSTRACT

A band clamp tightening tool comprising a cylindrical body, having at one end an internal bore adapted to pressfit the tool over the hex shaped head of a hose clamp adjustment screw, to which a combination crank/thumbscrew element has been affixed, said element being formed by passing a metal rod through a transverse aperture in the tool body, bending said rod to form a crank arm and a crank handle on one side of the body, and, on the opposite side of the tool body bending said rod to form a semicircular loop or thumbscrew element in the plane of the crank handle. In the use of this tool when attached to a hose clamp, the crank handle is rotated between the thumb and index finger to take up any slack in the band of the clamp, and to tighten the clamp the index finger is moved across the tool body to the thumbscrew loop, and the tool is turned as a large thumbscrew.

21 Claims, 3 Drawing Sheets

BAND CLAMP TIGHTENING MEANS

1. FIELD OF THE INVENTION

The field of the invention is tightening devices for banded clamping devices such as hose clamps.

2. BACKGROUND OF THE INVENTION

The prior art discloses many hose clamps, band clamps, and like clamping devices, and also many forms of clamping mechanisms usable to open and close such clamping devices. This vast prior art does not disclose, however, any manually operated band clamping device that, without any need for a driving tool, is capable both of rapid closing and release, and also of applying the tightening force required for the clamp's intended use.

The prior art discloses various means for tightening hose clamps and like band clamps without the use of a screwdriver or other hand tool. For example U.S. Pat. Nos. 1,412,187 (Lopdell), U.S. No. 1,553,081 (Humes), U.S. No. 2,553,390 (Streyckmans), and U.S. No. 2,897,569 (Kastner), disclose various forms of thumbscrews as the tightening means. Others, including U.S. Pat. No. 1,397,508 (Gillet), U.S. No. 2,541,206 (Christophersen), U.S. No. 3,916,489 (Berger), U.S. No. 4,468,842 (Perry/Campbell), and U.S. No. 4,083,588 (Berger) utilize variations on a "T" bar. U.S. Pat. No. 1,849,948 (Muchler) employs a removable bar to tighten a hose clip.

Although thumbscrews, T bars and removable bars are available means for tightening a hose clamp without an external driving tool, and each can be dimensioned to allow for the application of considerable force while tightening, none also provides a means to quickly "close" (or open) its associated clamp. These devices all require the user to reposition his or her grip repeatedly, with every quarter or half turn of a tightening screw, until all slack has been taken up and the application of clamping force can begin. At best this procedure is annoyingly slow and cumbersome.

U.S. Pat. No. 2,825,114 (Kolodin) discloses a hand crank as the tightening means for a bale-banding device. A crank is a device that allows for the continuous rotation of a shaft without change of grip, and it enables the rapid take-up of slack prior to the commencement of the actual clamping action, which typically requires much greater torque. Because a crank produces a turning force proportional to the length of its arm, however, its intended use as a clamp tightening means, as well as a clamp closing means, requires providing the crank with an arm having the greater radius necessary to generate the torques required for the tightening action. In turn this requires providing the crank with the lateral clearance, equal to the circular path drawn by the rotating crank arm, appropriate to that larger radius.

Where a crank is employed as a band tightening means, the band travels in a curved path directly beneath the adjustment screw to be cranked, and the crank arm must therefore be provided with lateral clearance from the band curving beneath it. Given the substantial torques generated in the clamping action, the required crank arm radius generally requires placement of the crank on a long stem or shaft, and the provision of bearing means for the shaft near its connection to the crank arm (as illustrated in Kolodin). This design is therefore limited to applications where the length of the crank shaft, and the offset of the arm of the crank, do not impede the intended functionality of the clamp. It is not suitable for ordinary hose clamps, where significant forces (in the order of 25–50 inch-pounds) must typically be applied to the adjustment screw, often in a small and compact footprint.

SUMMARY OF THE INVENTION

Therefore, it is a principal objective of the present invention to provide a means for quickly closing and opening, and for tightening, a band tightening clamp, without an external driver such as a screwdriver or nutdriver.

Another object of this invention is to provide, for us in a band tightening clamp such as a conventional screw-driven hose clamp, a tightening attachment or tool comprising a crank with a compact profile and footprint.

A first embodiment of the present invention is a tightening tool with a cylindrical body, bored at one end for attachment onto the adjustment screw of an ordinary hose clamp, across which a combination crank/thumbscrew element, formed from a bent metal rod, has been affixed. The attachment of this simple tool transforms a conventional hose clamp into a quick acting clamp that, without any recourse to an external tool, can be rapidly closed or loosened by rotation of the crank, and yet is capable of attaining high clamping forces, using, as a large thumbscrew, the crank handle and a formed loop opposite the crank handle.

The invention achieves high clamping force in a small turning radius through the combination of a short radius crank and a formed loop opposite the crank, a configuration that functions as a torque-doubling thumbscrew when the user applies torsional force simultaneously from both sides of the tool body. In this way, a crank handle having a 1" radius, for instance, coupled with the formed loop opposite the crank handle, also having a 1" radius, together enable a potential torque twice that of the crank handle alone, or equivalent to that of a crank with a 2" radius.

In the present invention the crank enables the rapid take-up of slack in the clamp band, an action requiring minimal torque that, for ordinary hose clamps, is typically the most time consuming part of the clamping procedure. Rotation of the crank with the thumb and index finger, in a conventional cranking action, rapidly takes up the slack. When the b and of the clamp begins to tighten around the object to be clamped, the user simply moves his or her index finger across the axis of the tool, to a position against the face of the formed loop, and proceeds to use the tool as a large thumbscrew.

Preferably, the end surface of the tool body opposite the internal bore is machined with a screwdriver slot, hex head , or similar tool-engaging surface, or a combination of such surfaces, suitable for a large screwdriver, nut driver or other driving tool, for applications where greater torque or more options are required.

The tool of the present invention may be manufactured as a detachable device, wherein the bored end of the tool is adapted to mate releasably with adjustment screws having a hex head or other conventional tool-engaging surface. For example a spring-loaded ball bearing (or ball bearings) may be fitted into the interior wall of said bore, to contact and engage the head of the adjustment screw.

In another embodiment of this invention, the crank/thumbscrew element of the invention is made integral to a lengthened adjustment screw of a band clamp assembly, thereby providing at minimal cost the quick closing and hand tightening features of the invention. In all embodiments it is desirable to enable the optional use of a conventional driving tool, such as a screwdriver or the like, by machining a screwdriver slot, external or internal hex, or other suitable tool receiving means in the free end of the tool.

In yet other embodiments, the crank arm is made slidable within the body of the tool, enabling the length of the crank arm to be easily altered by the user, for example to employ a longer crank arm during the band closing action, and a shorter crank arm matching the length of its opposite element during the tightening action. In a variant of these embodiments the crank/thumbscrew element is removable from the tool body.

The body of a tool in accordance with the invention may be provided with a ratcheting means, to allow for use in confined workspaces, where continuous rotary action is not possible.

This invention is suitable for any application where a combination crank handle and thumbscrew could be utilized to create a combination of quick action and sufficient clamping, screwing, or tightening force.

DETAILED DESCRIPTIONS OF THE DRAWINGS

Figure 1:
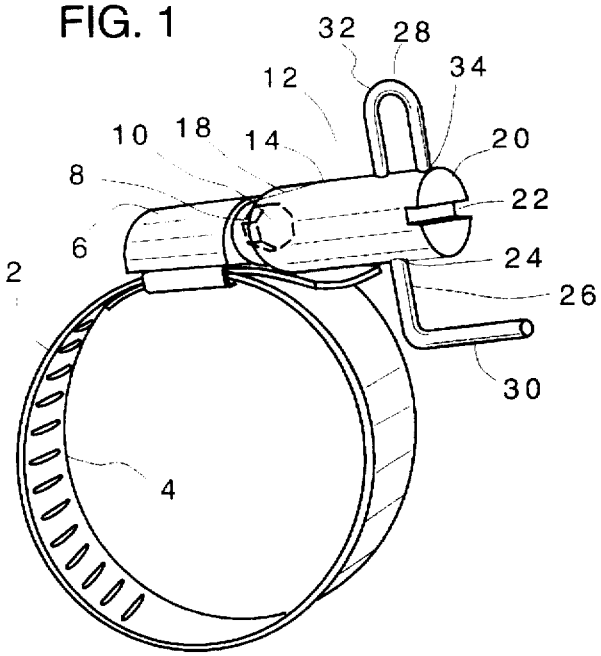
FIG. 1 perspective view of a band tightening tool according to the invention, shown press fit onto the head of the adjustment screw of a conventional ho clamp.

Referring to the drawings, FIG. 1 shows an ordinary hose clamp 2 having band 4, screw housing 6, and adjustment screw 8 with a hex-shaped head 10, onto which a tool 12 according to the invention has been permanently pressfit or welded. The body 14 of tool 12 is preferably manufactured of a strong and lightweight material such as aluminum, titanium or other metal, or a tough plastic like ABS. Tool body 14 is approximately 1–1½" in length and ½" in diameter, and it may be machined from solid cylindrical or hex-shaped stock, or from thick-walled tubular stock such as aluminum bushing stock. As shown in FIG. 1 the head 10 of hose clamp adjustment screw 8 is an external hex, typically 5/16" in diameter and ¼" in height, and usually it also comprises a screwdriver slot in its top surface (not shown). For pressfitting tool body 12 onto hex-shaped adjustment screw head 10, internal bore 16 is drilled in an end surface of tool body 14 and has a diameter slightly less than the largest cross-section of adjustment screw head 10. A slight taper 18 as shown on FIG. 1 may be machined onto the outside circumference of tool body 14 in the end region containing bore 16 to facilitate travel of band 4 past this point.

Although the end 20 of body 14 opposite bore 16 is preferably machined to include screwdriver slot 22, end 20 could also be machined to accommodate an internal or external hexhead driver, an internal or external square head driver, or other suitable means for receiving one or more of such driving tools.

At a point intermediate the midpoint of tool body 14 and its end 20, insertion hole 24 has been drilled entirely through body 14 perpendicular to the length of said body and sized to receive rod 26 of crank/thumbscrew element 28. In FIG.1 crank/thumbscrew element 28 is made from a metal rod 26 with a diameter, for instance, of 3/16" . One end of rod 26 is bent approximately 90° to form crank handle 30. In a preferred method for making the tool of the present invention, rod 26 is inserted through hole 24 in tool body 14 and the inserted end of rod 26 now on the side of tool body 14 opposite crank handle 30 is bent and formed into semicircular loop 32. The free end of loop 32 is then press fit into slightly undersized hole 34, which has been drilled into tool body 14 a short distance along the length of said body directly above rod insertion hole 24. Thereby crank/thumbscrew element 28 is securely affixed to body 14 with loop 32 suitably positioned for use as a thumbscrew element. Tool 12 as shown in FIG. 1 is press fit onto the head 10 of hose clamp adjustment screw 8, but said tool may in the alternative be spot welded, glued, or the like, onto said adjustment screw head.

Figure 2:
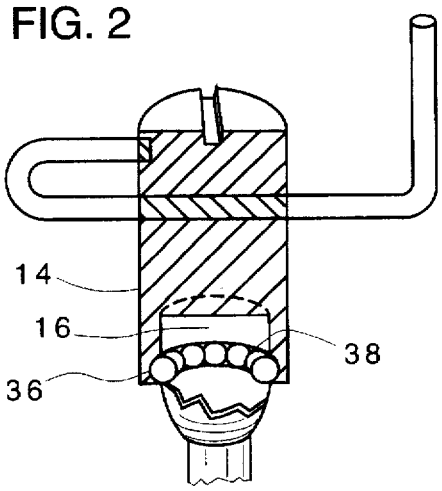
FIG. 2 a transverse section through a detachable variant of the embodiment FIG. 1.

FIG. 2 illustrates a detachable version of the tool of FIG. 1. Bore 16 at one end of tool body 14 has been machined and sized to accommodate readily the external hex configuration typical of the head of ordinary hose clamp adjustment screws, and, to maintain a tight fit during operation, small spring-loaded ball bearings 36 have been positioned into channel 38 machined into the wall of internal bore 16. For a more positive connection, a small detent, or detents, positioned to receive said bearing, or bearings, may also be machined into a side surface, or surfaces, of the adjustment screw head. Instead of spring loaded ball bearings, a circular spring clip housed in a groove internal to the attachment may be employed to form a releasable attachment to the clamp adjustment screw, or a set screw may be used. Still other detachable embodiments are possible utilizing other known interlocking means.

Figure 3:
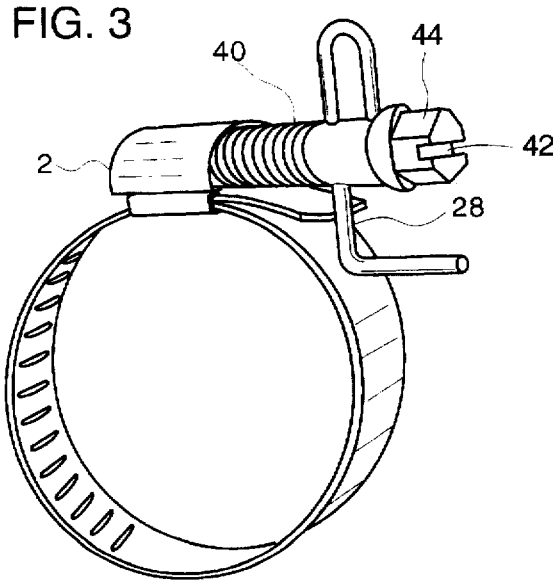
FIG. 3 is a perspective view of a another embodiment of the invention, integral to a modified hose clamp adjustment screw.

In another embodiment of the present invention, illustrated in FIG. 3, hose clamp 2 is provided with an elongated adjustment screw 40 (approximately "1½" longer than normal), and crank/screw element 28, identical to that described above with respect to FIG. 1, is incorporated into the body of said elongated adjustment screw. Alternatively, crank/thumbscrew element 28 may simply be welded, glued or otherwise securely affixed within screwdriver slot 42 normally positioned in the head 44 of elongated adjustment screw 40, in a transverse position corresponding to that shown in FIGS. 1 and 2 for crank/thumbscrew element 28.

Figure 4:
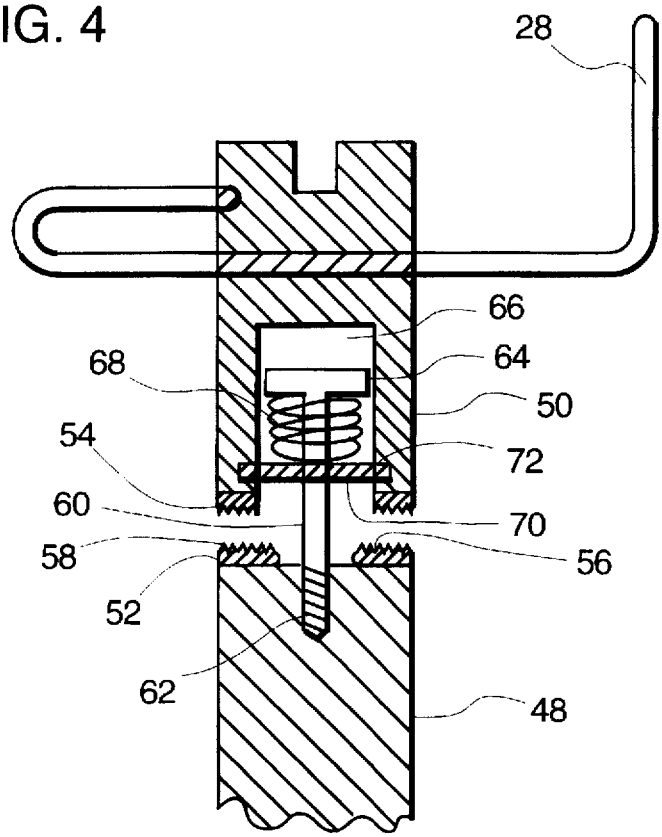
FIG. 4 a traverse section through a portion of a device made in accordance with the invention, illustrating a ratchet means therefor.

FIG. 4 illustrates ratchet means that may be incorporated into the body 14 of tool 12 shown in FIG. 1, or into the body of elongated adjustment screw 40 shown in FIG. 3. Referring to FIG. 4 the tool body has been cut into a lower portion 48 and an upper portion 50 containing crank/thumbscrew element 28. Portions 48 and 50 have been provided with interlocking annular contact surfaces 52 and 54, both machined with alternating slots 56 and bosses 58. A capped stud 60 joins portions 48 and 50, having one end 62 secured to lower portion 48 (arbitrarily), while its opposite, capped end 64 floats within a cylindrical chamber 66 bored in the base of upper portion 50, and there is held under compression by helical spring 68 confined between cap 64 of stud 60 and annular retainer ring or clip 70 secured in groove 72 machined into the wall of chamber 66. As a result spring tension holds interlocking portions 48 and 50 strongly together as one, except when upper portion 50 is pulled upward and disengaged from lower portion 48, thereby allowing for its rotation about the axis of stud 60 and a corresponding repositioning of crank/thumbscrew element 28 within said upper portion 50. This ratcheting feature enables sequential partial turnings of a hose clamp adjustment screw, as necessary for example in very restricted areas where continuous turning of crank/thumbscrew element 28 is not feasible.

Figure 5:
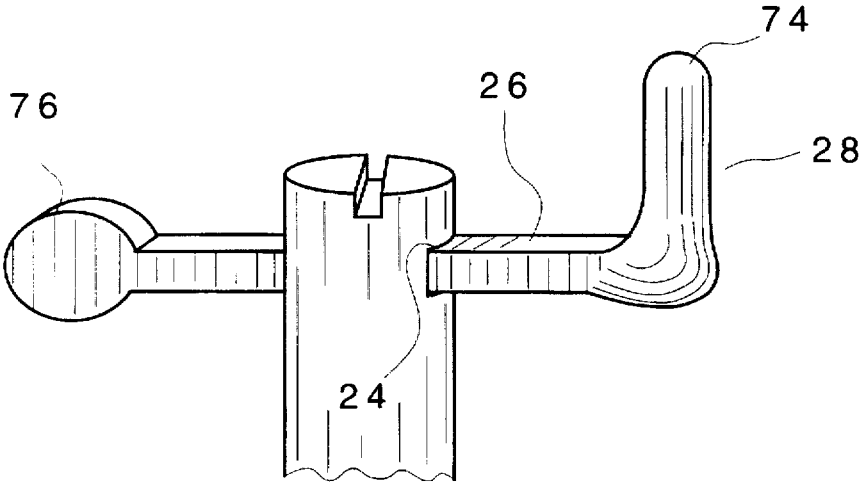
FIG. 5 is a variant of the devices of FIG. 1 and FIG. 3, wherein the crank/thumbscrew element is made from flat stock.

FIG. 5 illustrates an embodiment, otherwise similar to those of FIG. 1 and FIG. 3, wherein rod 26 of crank/thumbscrew element 28 is fashioned from square stock instead of round stock. One end square stock rod 26 is bent to a 90° angle and dressed to form smooth, round crank handle 74. Square stock rod 26 is then inserted through insertion hole 24 in body 14 of tool 12 shown in FIG. 1, or in a like insertion hole in the body of elongated adjustment screw 40 shown in FIG. 3, said insertion hole having been "squared"for this purpose, with crank handle 74 extending upward as shown parallel to the long axis of said tool or elongated screw. Following its insertion through hole 24, the free end of square stock rod 26 opposite crank handle 74 may be machined to form bulbous shape 76 illustrated in FIG. 5, or left as is, thereby rendering crank/thumbscrew element 28 entirely removable.

Figure 6:
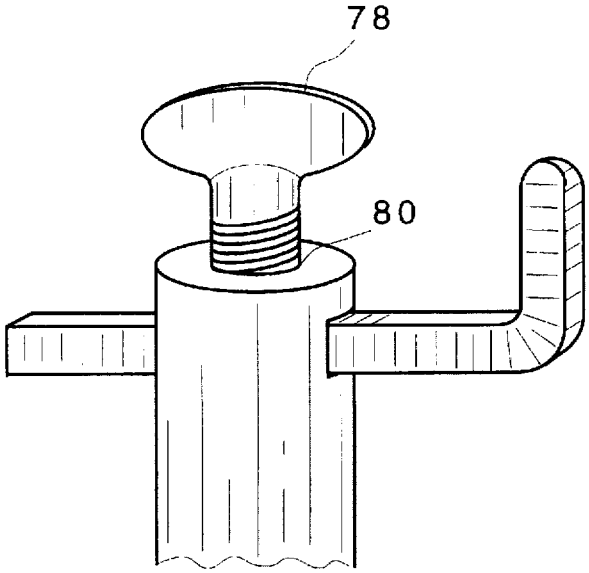
FIG. 6 is another variant of the devices of FIG. 1 and FIG. 3, provided with an adjustable and removable crank arm.

In embodiments of the invention like that illustrated in FIG. 5 the transverse position of the crank arm within body 14 of tool 12, or within the body of elongated adjustment screw 40, may be rendered selectively adjustable, for example as illustrated in FIG. 6 by means of a small setscrew or thumbscrew 78 suitably positioned in an additional, threaded hole 80 in the side or top of body 14 of tool 12. Alternatively a leaf spring or ball detents (not shown) may be positioned within insertion hole 24, to enable selective positioning of the crank arm extension of crank/thumbscrew element 28 within said insertion hole.

Figure 7:
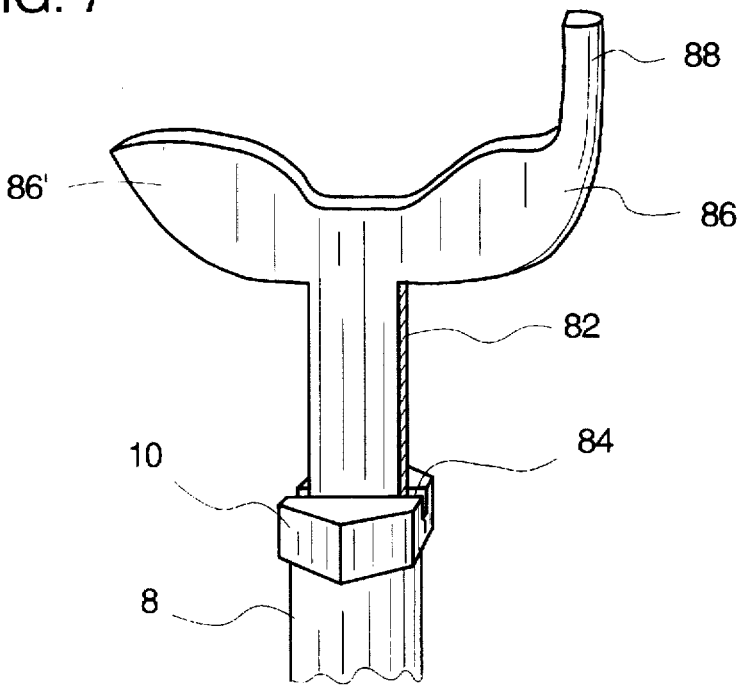
FIG. 7 a perspective view of a crank/thumbscrew element usable in other embodiments of the invention.

FIG. 7 illustrates yet another embodiment of the invention, wherein a crank/thumbscrew element 82, having base 84 and wingnut-type wings 86 and 86', has been stamped from a piece of flat stock, for attachment within the screwdriver slot in the head 10 of an ordinary hose clamp adjustment screw 8. Base 84 of crank/thumbscrew element 82 is sized to be pressfit, spot welded or glued within said slots, and either (or both) of wings 86 and 86' has an extension 88 that has been rounded, dressed and smoothed to form a crank handle. Crank handle 88 may be integral to wing 86, as shown in FIG. 7, or it may be a separate element, for example riveted to wing 86 and pivotable to a resting position astride wings 86 and 86'.

In the use of a conventional hose clamp, the actions needed to loop the band of the clamp around an object, and to thread the tip of the band through the adjustment screw housing of the clamp, are often awkward and difficult, especially in confined workspaces. First, the user must bring the tip of the clamp band into alignment with a small aperture in the adjustment screw housing; next the user must maintain sufficient joining pressure on these two elements, with one hand, for the adjustment screw to grab the tip of the band, even as, with a screwdriver or other turning tool in his or her other hand, the user seeks to turn the head of the adjustment screw. This operation usually involves a good deal of fumbling, and repeated failures to keep the driver properly slotted onto the head of the adjustment screw, as the user repositions the turning hand after each quarter or half turn of the screw, before the band of the hose clamp "catches" onto the adjustment screw.

Having successfully threaded the looped band into the adjustment screw housing, the user then has to take up the slack in the band before the actual clamping action can begin. If the user lacks a ratchet wrench or an electric screwdriver, or if the available workspace precludes their use, this operation too is likely to be awkward, time consuming, and annoying. As a result the two operations described absorb most of the time and energy used in placing hose clamps, while the actual clamping action usually requires only a few turns of the adjustment screw. The placement of a hose clamp using the present invention is quite different, and involves far less effort and frustration.

Referring by way of illustration to FIG. 1, the user pressfits tool 12 onto the head of the adjustment screw of a conventional hose clamp, loops the band of the clamp around the object to be clamped, and brings the tip of the band to the receiving aperture in the adjustment screw housing. Then, instead of fumbling with a screwdriver, the user merely grasps crank handle 30 between the thumb and index finger of one hand, and turns the handle with an efficient, continuous rotary action, with no need for any repositioning of hands until the clamp has caught and all slack has been taken up. At this point, the user re-positions the turning hand to grasp crank/thumbscrew element 28 like a large thumbscrew, and with a few quick turns the hose clamp is securely tightened into place.

It should be readily apparent to those skilled in the mechanical arts to which the present invention pertains that other embodiments employing similar crank/thumbscrew mechanisms are possible. It is therefore to be understood that the scope of the present invention is not limited to its detailed description and illustration herein, and that many other modifications may be made without departing from the invention. It is therefore intented that the appended claims cover all such variations and modifications as come within the true spirit and scope of the invention.

I claim:

1. A tool for use with a hose clamp having an adjustment screw, said tool comprising:

a) an elongated body, having at one end means for attaching the tool to the head of an adjustment screw, and b) a crank/thumbscrew element secured to said body, having thumbscrew means extending outwardly from opposite sides said body and having a crank handle means extending substantially parallel to said body for continuous rotation of said body.

2. The tool of claim 1 wherein the crank/thumbscrew element is secured to the tool body within a slot in the end of the tool body opposite that having means for attaching the tool to the head of an adjustment screw.

3. The tool of claim 2 wherein the crank/thumbscrew element is a wingnut having two wings and a crank handle on at least one wing.

4. The tool of claim 3 wherein said crank handle is pivotable.

5. The tool of claim 1 wherein the crank/thumbscrew element comprises a rod passed through and extending from opposite sides of a transverse aperture in the body of said tool to form on one side of said body a crank arm, and a crank handle formed substantially parallel to the tool body by a bend in said crank arm.

6. The tool of claim 5 wherein the crank/thumbscrew element further comprises:

A thumbscrew formed in the plane of the crank handle by a substantially semi-circular loop in said rod on the side of the tool body opposite the crank handle.

7. The tool of claim 5 further comprising:

A thumbscrew formed in the plane of the crank handle by a surface shaped from a portion of said rod on the side of the tool body opposite the crank handle.

8. The tool of claim 5 further comprising:

Means for selectively adjusting the position of the rod within the aperture in the tool body to vary the extension of the crank arm.

9. The tool of claim 8 wherein said crank/thumbscrew element is removable.

10. The tool of claim 1 wherein the means for attaching the tool to the head of a hose clamp adjustment screw comprises an internal bore containing means for releasably securing the tool to the head of an adjustment screw.

11. The tool of claim 1 further comprising ratcheting means.

12. The tool of claim 11 wherein, to form the ratcheting means, the tool body comprises:

A lower portion comprising the internal bore for releasably attaching the tool to a hose clamp adjustment screw, a separate upper portion comprising said crank/thumbscrew element, and means for releasably interlocking said lower portion and said upper portion at a plurality of relative radial positions.

13. A hose clamp having an adjustment screw comprising:

a body, and a crank/thumbscrew element secured to said body, having thumbscrew means extending outwardly from opposite sides said body and having a crank handle means disposed substantially parallel to the axis of said adjustment screw for continuous rotation of said body 14. The hose clamp of claim 13 wherein said crank/thumbscrew element comprises a rod passed through a channel in the body of said adjustment screw to form a crank arm, and a crank handle formed substantially parallel to said elongated body by a bend in said crank arm.

15. The hose clamp of claim 14 wherein said channel is an aperture drilled through the body of said adjustment screw.

16. The hose clamp of claim 13 wherein the crank/thumbscrew element further comprises:

A thumbscrew formed in the plane of the crank handle by a substantially semi-circular loop in said rod on the side of the adjustment screw body opposite the crank handle.

17. The hose clamp of claim 13 wherein the crank/thumbscrew element further comprises:

A thumbscrew formed in the plane of the crank handle by a surface shaped from a portion of said rod on the side of the adjustment screw body opposite the crank handle.

18. The hose clamp of claim 13, wherein said crank/thumbscrew element is secured to the body of said adjustment screw within a screwdriver slot in the head of said adjustment screw.

19. The hose clamp of claim 18 wherein said crank/thumbscrew element is shaped into a wingnut having two wings and a crank handle on at least one wing.

20. The hose clamp of claim 13 further comprising ratchet means.

21. The hose clamp of claim 20 wherein, to form said ratchet means, the hose clamp adjustment screw comprises:

an externally threaded lower portion, a separate upper portion comprising the crank/thumbscrew element, and means for releasably interlocking said lower portion and said upper portion at a plurality of relative radial positions.

* * * * *